United States Patent [19]

Koch

[11] 4,206,876

[45] Jun. 10, 1980

[54] SLOT NOZZLE

[75] Inventor: Werner Koch, Wald Michelbach, Fed. Rep. of Germany

[73] Assignee: Bruckner Apparatebau GmbH, Erbach, Fed. Rep. of Germany

[21] Appl. No.: 943,006

[22] Filed: Sep. 18, 1978

[30] Foreign Application Priority Data

Oct. 12, 1977 [DE] Fed. Rep. of Germany ..... 2745900

[51] Int. Cl.[2] ..... B05B 1/04

[52] U.S. Cl. ..... 239/455

[58] Field of Search ..... 239/506, 451, 455, 597; 294/63 A

[56] References Cited

U.S. PATENT DOCUMENTS

| | | | |
|---|---|---|---|
| 3,392,919 | 7/1968 | Wies | 239/455 |
| 4,132,363 | 1/1979 | Kruger | 239/455 |

*Primary Examiner*—James B. Marbert

*Attorney, Agent, or Firm*—Jones, Thomas & Askew

[57] ABSTRACT

A slot nozzle for a flow medium is formed by a pair of side walls joined together by a connecting wall with a weakened zone that forms a hinge between the side walls. The slot width of the nozzle is adjustable by relative adjustment of the two side walls defining the slot, on the one hand by the pressure of the flow medium disposed in the slot nozzle acting in the sense of opening the slot and on the other hand by the counter pressure of a fluid acting in the sense of closing the slot.

17 Claims, 4 Drawing Figures

SLOT NOZZLE

BACKGROUND OF THE INVENTION

Slot nozzles are used generally for various purposes for forming jets of gaseous or liquid fluid, for example onto a surface (eg. a moving fabric web or plate). Particular difficulties occur above all when the expelled flow medium is to be utilized to exert a high mechanical effect on a surface to be processed and in addition a relatively large working width is necessary with correspondingly large slot nozzle length.

Generally speaking, various nozzle designs are known in practice which comprise for example walls connected by screws or other connecting members and defining the slot, said walls being adjustable with respect to each other to obtain a definite slot width. To obtain a uniform nozzle effect it is further known to incorporate mechanical reinforcements in the interior of the nozzle. However, it has repeatedly been found in practice that a relative adjustment of the two walls defining the slot is comparatively complicated and expensive and that in addition the reinforcement fittings provided inside tend to promote the deposition of impurities and this can rapidly impair uniform operation of such a slot nozzle over its entire working length.

To extrude and cast foils, films or photographic emulsions an encased wide slot nozzle is also known (DE-OS No. 2,022,415) in which the actual nozzle body is formed by two nozzle halves which enclose a cavity and define a nozzle slot with their longitudinal edges. The nozzle body formed from these two nozzle halves is suspended freely moveable within a separate housing. The drawings indicate moreover that the adjacent longitudinal sides of the two nozzle halves opposite the nozzle slot are merely pressed loosely against each other and permit a relative movement of the two longitudinal edges defining the slot. With such an embodiment it is however frequently difficult to control exactly the pressure acting in the outer surrounding chamber (the so-called compensation chamber) on the nozzle halves and thus in turn the particular slot width required.

SUMMARY OF THE INVENTION

The invention is thus based on the problem of providing a nozzle of the type mentioned at the beginning which is of relatively simple construction and is very reliable in operation, particularly if a high mechanical effect is to be exerted on a moving surface to be processed.

This problem is solved according to the invention in that the two walls defining the slot are connected together by a connecting wall extending over the entire working length parallel to the slot, said connecting wall having a centre zone which extends over its entire length and is weakened in its material thickness and which is resiliently deformable and forms the pivot axis.

Since in this embodiment according to the invention the two walls defining the slot are formed by a connecting wall simultaneously permitting relative pivotability of the two walls, an extremely robust but relatively simply constructed and extremely reliable slot nozzle is obtained. This slot nozzle can be adjusted very rapidly and extremely uniformly by the aforementioned pressures in its slot width over the entire working length of the slot by the corresponding pressure changes (whether by the flow medium or by the fluid). Due to this reliable and excellent adjustment facility and the robust construction the slot nozzle according to the invention is particularly suitable for operation in which a liquid or gaseous flow medium is to be expelled with high mechanical effect on a moving surface to be processed (in particular textiles or other fabric webs).

In advantageous manner, in this slot nozzle according to the invention it is further possible to increase the slot width at certain intervals prematurely so that any impurities which have collected in the cavity of the nozzle can be flushed out of the nozzle. This makes the operation of the nozzle particularly reliable when using gaseous or liquid flow media.

The slot nozzle according to the invention is expediently so constructed that the walls defining the slot—seen in the cross-section of the nozzle—are formed by two side walls defining an inner cavity which coverge downwardly in the direction towards the slot in the manner of a blade edge. The flow medium disposed in the cavity of the slot nozzle can thus be accurately supplied to the slot.

According to one embodiment of the invention the slot nozzle is so constructed that the connecting wall—seen in the cross-section of the nozzle—divides the cavity defined by the side walls into a lower pressure chamber conducting the flow medium to be expelled from the slot and an upper counter pressure chamber conducting the fluid for producing the counter pressure acting in the closure sense of the slot. The flow medium disposed in the lower pressure chamber, due to its inherent pressure, tends to increase the slot width; on the other hand, in the upper counter pressure chamber the pressure of the fluid represents a counter pressure by which at least one of the side walls can be pivoted about the aforementioned axis to enable the desired slot width to be set.

A particularly uniform slot width adjustment over the entire working length of the slot can be achieved especially when in the upper counter pressure chamber a flexible tube conveying the fluid is provided, the walls of which are in contact with the counter pressure chamber walls and are resiliently deformable in dependence upon the particular counter pressure obtaining.

In another embodiment of the invention the connecting wall may form the upper closure of the cavity and at least on the outside of the one side wall a resiliently deformable counter pressure chamber may be provided in which the fluid producing a counter pressure on the corresponding side wall is conducted.

Further details of the invention will be apparent from the remaining subsidiary claims and from the following description of some examples of embodiment illustrated in the drawings.

DETAILED DESCRIPTION

Figure 1:
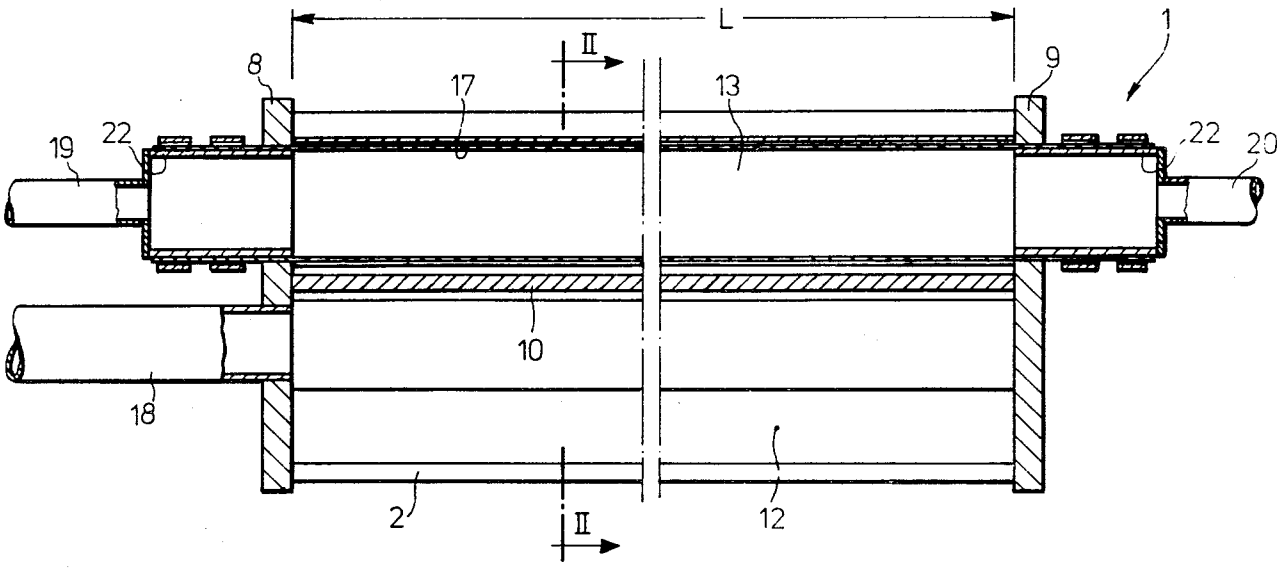
FIG. 1 is a longitudinal sectional view of a first embodiment of the slot nozzle according to the invention.
Figure 2:
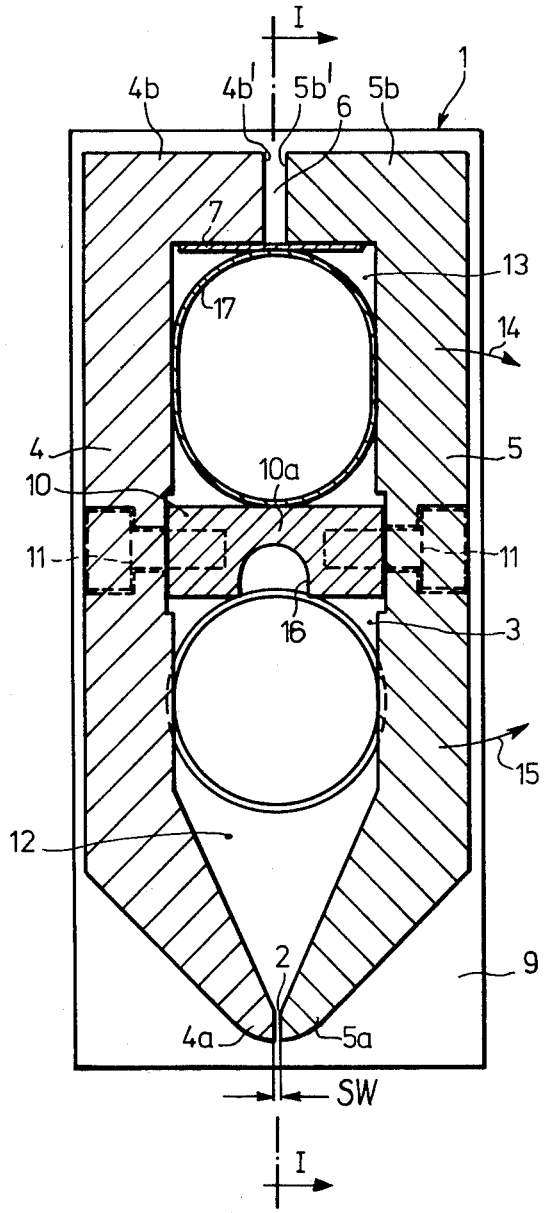
FIG. 2 is a cross-section through the slot nozzle of FIG. 1 along the line II—II of FIG. 1.

With reference to FIGS. 1 and 2 a first example of embodiment of a slot nozzle 1 will be described; this is intended particularly for a liquid flow medium which is to impinge with high mechanical effect on a moving web of material, in particular a fabric.

The slot nozzle 1 comprises two walls which define the slot 2 and which, of the cross-section of FIG. 2, are formed by two side walls 4, 5 which define an inner cavity 3 of the slot nozzle and which converge downwardly in the direction towards the slot 2 in the manner of a blade edge, i.e. the two opposing lower ends 4*a*, 5*a* of the side walls 4, 5 define the actual slot 2. The side walls 4, 5 are angled with respect to each other and their upper ends 4*b*, 5*b*, their opposing edges 4*b'* and 5*b'* being spaced from each other so that the slot opening 6 thus formed permits relative movement of the two side walls 4, 5. On the other hand, to ensure that the cavity 3 is sealed with respect to the slot opening 6 a cover strip 7 is disposed beneath the slot opening 6 and is preferably fixedly connected only to the one side wall (e.g. 5) while being in sliding contact with the other side wall (e.g. 4).

The slot nozzle 1 has a relatively large working length L (for example of several meteres) and comprises at its end faces end plates 8, 9 which are connected to the side walls 4, 5 in suitable manner so that a relative adjustment of the two side walls 4, 5 is possible as will be described in detail hereinafter.

As can be seen clearly in particular from the cross-sectional view of FIG. 2 the inner cavity 3 of the slot nozzle 1 is divided by a connecting wall 10 secured by screws 11 to the side walls 4, 5 into a lower pressure chamber 12 and an upper counter pressure chamber 13. The flow medium to be expelled from the slot 2 is conveyed in the lower pressure chamber 12 whilst the upper counter pressure chamber 13 carries a fluid which produces a pressure in the sense of closure (arrow 14) of the slot 2 acting counter to the pressure of the flow medium (in the lower pressure chamber 12) acting in the sense of an opening (arrow 15) of the slot 2. The effect of these two pressures, at least one of which is adjustable, permits a relative adjustment of the two side walls 4, 5 and thus an adjustement of the slot width SW of the slot 2 in the desired manner.

The latter relative adjustment of the two side walls 4, 5 is however made possible only by the constructional form of the connecting wall 10. This connecting wall 10 extending over the entire working length L of the slot nozzle 1 comprises a centre zone 10*a* which extends over its entire length and is weakened in its material thickness, said zone being produced in this case merely by a longitudinal groove 16 worked unilaterally into the connecting wall 10 and thereby forming a resiliently deformable material zone (centre zone 10*a*) which extends parallel to the slot 2. By this resiliently deformable centre zone 10*a* the two side walls 4, 5 can be pivoted relatively to each other about an axis (either in the direction of the arrow 14 or in the direction of the arrow 15) which extends parallel to the slot 2 and is contained in the centre zone 10*a*.

The fluid conducted in the upper counter pressure chamber 13 is preferably a hydraulic fluid which permits exact adjustability. To enable the slot nozzle 1 to be adjusted precisely over its entire working length to the same slot width SW, in this first example of embodiment (FIGS. 1 and 2) in the upper counter pressure chamber 13 a flexible tube 17 is provided which carries the fluid and the walls of which are in contact with the walls of said counter pressure chamber 13 and can be resiliently deformed in dependence upon the counter pressure obtaining in the flexible tube. This means that when the counter pressure in the flexible tube 17 is increased the walls thereof are pressed with greater force against the side walls 4, 5 of the slot nozzle so that at least one of said side walls is pivoted in the direction of the arrow 14 about the pivot axis contained in the centre zone 10*a* of the connecting wall 10 so that the slot width SW of the slot 2 diminishes; on the other hand, assuming a constant pressure in the lower pressure chamber 12, reduction of the counter pressure in the flexible tube 17 leads to a compression of the flexible tube walls and thus to a pivot movement of the side walls 4 and/or 5 in the opposite direction (arrow 15), thus increasing the slot width SW of the slot 2. It is pointed out in this connection that either only one of the two side walls 4, 5 or both side walls may be made pivotal and that an excess pivoting of the side walls 4, 5 produced by one of the superimposed pressure chambers can be counteracted either by reducing the pressure in said pressure chamber or increasing the pressure in the other pressure chamber, taking account in each case however of the resetting force to the neutral position inherent in the centre zone 10*a* of the connecting wall 10.

Regarding the construction of the slot nozzle illustrated in FIGS. 1 and 2 it is further pointed out that the flow medium to be expelled from the slot 2 is supplied via a tube 18 mounted at the one end plate (e.g. 8) and opening into the lower pressure chamber 12 whilst the preferably liquid fluid to be introduced into the flexible tube 17 of the upper counter pressure chamber 13 is supplied via a conduit 19 and can possibly be led off via a conduit 20; the flexible tube 17 is secured at its end in suitable manner on sockets 21, 22 (e.g. with pipe clips) and fixed in the end plates 8, 9 of the slot nozzle 1. It is obvious that this slot nozzle 1 is provided with means, not illustrated in detail, for pressure monitoring and adjustment and for conducting the flow medium to the lower pressure chamber 12 as well as for conducting the fluid to the upper counter pressure chamber 13.

Figure 3:
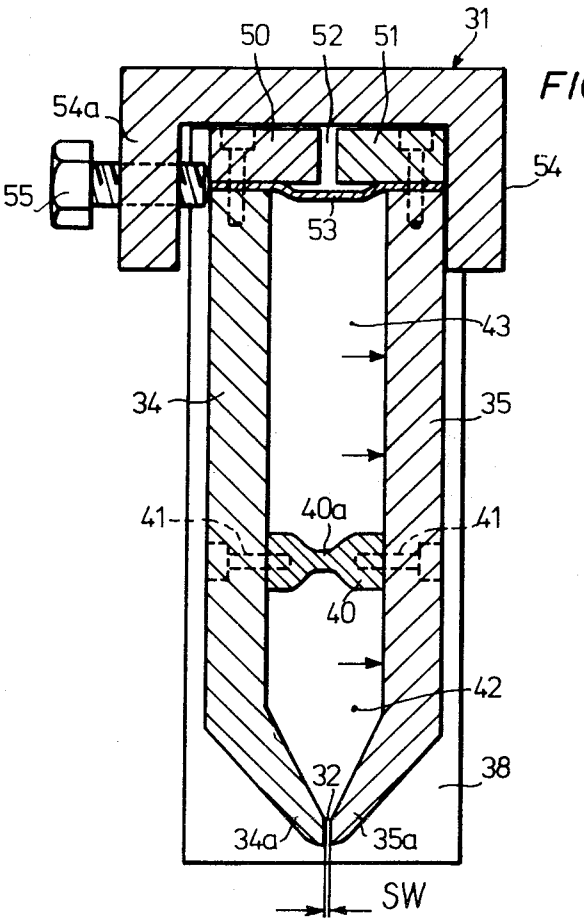
FIG. 3 is a sectional view similar to FIG. 2 but of a second embodiment of the invention.

A modification of the first example of embodiment described with the aid of FIGS. 1 and 2 is illustrated in FIG. 3, only in cross-section. This slot nozzle 31 also comprises two side walls 34, 35 whose lower ends 34*a*, 35*a* converge to form as it were a blade edge and define the slot 32. At least one of these two side walls 34, 35 can be pivoted about an axis which extends parallel to the slot 2 and which is contained in the centre zone 40*a*, weakened in its material thickness, of the connecting wall 40 which connects the two side walls (with the aid of screws 41) and divides the cavity of the nozzle 31 defined by the side walls 34, 35 into a lower pressure chamber 42 and an upper counter pressure chamber 43. In this case the lower pressure chamber is made substantially smaller in volume than the upper counter pressure chamber and in addition a cover-like material strip 50, 51 is screwed onto each of the upper ends of the side walls 34, 35 and between the two opposing edges of said strips 50, 51 a slot opening 52 is provided for a relative movement of the two side walls 34, 35. In addition, beneath the two strips 50, 51 a continuous sealing strip 53 is disposed and secured in such a manner that it does not prevent the relative movement between the two side walls 34, 35. The end faces of said slot nozzle 31 are also closed by end plates 38 (as in the case of FIGS. 1 and 2).

An important modification of this second embodiment of the invention (compared with the example of FIGS. 1 and 2) resides in that at least one U-shaped bracket 54 engages from above over the strips 50, 51 and the upper ends of the side walls 34, 35. Screwed into one leg 54*a* of the U-shaped bracket 54 is an adjustment screw 55 by means of which the particular minimum slot width permited by relative adjustment of the two side walls 34, 35 can be set.

A further modification of the first example of embodiment in the embodiment of FIG. 3 is that no flexible tube is provided in the upper counter pressure chamber 43.

Whereas in the example of embodiment of FIGS. 1 and 2 a fluid is preferably introduced into the upper counter pressure chamber which differs from the flow medium disposed in the lower pressure chamber, in the example of embodiment of FIG. 3 a pressurized preferably liquid flow medium which is introduced into the pressure chamber 42 for expulsion from the nozzle 32 is also utilized simultaneously for producing the counter pressure in the upper counter pressure chamber 43 and for this reason the upper counter pressure chamber 43 has a substantially greater volume than the lower pressure chamber 42. The upper counter pressure chamber 43 is therefore connected by a bypass conduit not shown in detail to the supply line of the flow medium to be introduced into the lower pressure chamber 42 and expelled from the slot 32. In practice, the arrangement is such that, considering the longitudinal sectional view of FIG. 1, a bypass conduit is connected to the supply tube 18 of the flow medium for the lower pressure chamber 42, said bypass conduit connecting the supply line 19 for the upper counter pressure chamber 43. In the bypass conduit an adjustable pressure relief valve is preferably disposed by which the pressure in the upper counter pressure chamber 43 can be automatically set. With this second embodiment of the invention it is possible in simple manner (with only one liquid pump) to set the counter pressure to be adjusted in the upper counter pressure chamber 43 simultaneously with the pressure from the lower pressure chamber 42—via the slot 32.

Of course, in the case of FIG. 3 as well a tube with resiliently deformable walls could also be provided in the upper counter pressure chamber 43 as was done in the first example of embodiment (FIGS. 1 and 2).

Figure 4:
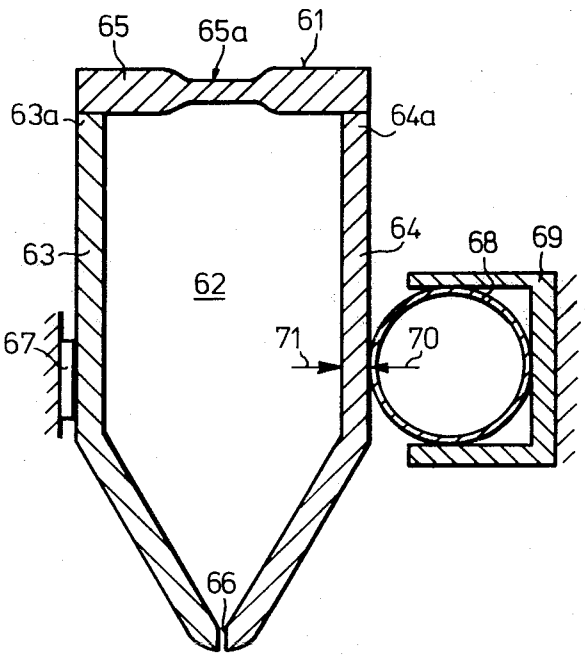
FIG. 4 is a cross-sectional view of a third example of embodiment of the slot nozzle according to the invention.

FIG. 4 finally illustrates an embodiment of a slot nozzle 61 according to the invention in which the side walls 63, 64 defining the inner cavity 62 are also connected by a connecting wall 65 and pivotal relatively to each other. The side walls 63, 64 extend in the same manner as in the preceding examples of embodiment downwardly in the direction towards the slot 66 in the manner of a blade edge.

In contrast to the preceding examples of embodiment, the side walls 63, 64 of the slot nozzle are connected together at their upper ends 63*a*, 64*a* by the connecting wall 65 which forms the upper closure of the cavity 62; the cavity 62 forms in this case only a single pressure chamber for the flow medium to be expelled from the slot 66. The connecting wall 65 is again provided with a centre zone 65*a* extending over the entire length and weakened in its material thickness, forming a resiliently deformable material zone which contains an axis about which in this example only the side wall 64 can be pivoted while the side wall 63 is fixed by a fixed element 67. On the outside of the pivotal side wall 64 a deformable counter pressure chamber is provided in the form of a flexible tube 68 which has resiliently deformable walls. This tube 68 is disposed between the said side wall 64 and a fixed counter surface 69 and is in contact with both elements so that by introducing a fluid into the flexible tube 68 a resilient deformation thereof can be achieved so that a counter pressure acting in the direction of the arrow 70 on the ouside of the side wall 64 is produced in the sense of closure of the slot 66; on the other hand, the flow medium disposed in the cavity 62 exerts on the inside of the side wall 64 a pressure in the direction of the arrow 71, thus producing, when the pressure has a corresponding magnitude, pivoting of the side wall 64 in the sense of opening the slot 66.

Whereas in the example of embodiment of FIG. 4 only the one side wall (64) is pivotal it is of course also possible to mount both side walls (63, 64) in pivotal manner and to provide a resiliently deformable counter pressure chamber in the form of a flexible tube at the outsides of each of these two side walls.

While this invention has been described in specific detail with particular reference to preferred embodiments thereof, it will be understood that variations and modifications can be effected within the spirit and scope of the invention as described hereinbefore and as defined in the appended claims.

What is claimed is:

1. A slot nozzle for a flow medium in which the slot width is adjustable by relative adjustment of two sidewalls defining the slot, on the one hand by the pressure of the flow medium disposed in the slot nozzle acting in the sense of opening of the slot and on the other hand by the counter pressure of a fluid acting in the sense of closing the slot, and at least one of the two sidewalls defining the slot being pivotal about an axis extending parallel to the slot, characterized in that the two sidewalls defining the slot are connected together by a connecting wall extending over the entire working length of the slot nozzle parallel to the slot, said connecting wall including a zone which extends over its entire length and is weakened in its material thickness and which is resiliently deformable and forms the pivot axis.

2. The slot nozzle according to claim 1 characterized in that the connecting wall divides the cavity defined by the sidewalls into a lower pressure chamber conducting the flow medium to be expelled from the slot and an upper counter pressure chamber conducting the fluid for producing the counter pressure acting in the closure sense of the slot.

3. The slot nozzle according to claim 2, characterized in that in the upper counter pressure chamber a flexible tube for conducting the fluid is provided, the walls of said flexible tube being in contact with the counter pressure chamber walls and being resiliently deformable in dependence on the particular counter pressure obtaining.

4. The slot nozzle according to claim 2, characterized in that said lower pressure chamber and said upper counter pressure chamber are substantially equally sized and means for conducting different media flow through the two pressure chambers.

5. The slot nozzle according to claim 2, characterized in that the upper counter pressure chamber is larger than the lower pressure chamber, a supply conduit connected to said lower pressure chamber, and a bypass conduit connecting the counter pressure chamber to the supply conduit.

6. The slot nozzle according to claim 5, characterized in that an adjustable pressure relief valve is disposed in the bypass conduit.

7. The slot nozzle according to claim 2, characterized in that the upper counter pressure chamber has associated therewith an adjusting means for setting the minimum slot width.

8. The slot nozzle according to claim 1, characterized in that a cavity is formed by the connecting wall and the two sidewalls and at least on the outside of one of the side walls a resiliently deformable counter pressure chamber is provided in which the fluid producing a counter pressure on said wall is conducted.

9. A slot nozzle according to claim 8, characterized in that the resiliently deformable counter pressure chamber is formed by a flexible tube.

10. An adjustable slot nozzle comprising:

two opposing side walls forming an inner cavity therebetween to receive a first fluid under pressure and further defining an elongated slot therebetween, said slot communicating between said inner cavity and the outside of the slot nozzle;

a connecting member connecting said two opposing side walls, said connecting member including a resiliently deformable material zone of reduced thickness intermediate said opposing side walls for resiliently supporting said two opposing side walls in movable relationship with respect to each other about an axis parallel to said elongated slot;

pressure means for exerting pressure on at least one of said side walls and for pivoiting said one side wall about said axis whereby the width of said slot is varied.

11. The adjustable slot nozzle according to claim 10 and wherein said connecting member comprises a connecting wall that divides said inner cavity into a pressure chamber that communicates with said slot and a counter pressure chamber, and means for supplying fluid to said pressure chamber and to said counter pressure chamber.

12. A slot nozzle for a flow medium comprising a pair of spaced walls defining a cavity and a slot therebetween in which the slot width is adjustable by relative adjustment of the two walls defining the slot, said walls being connected together by a connecting wall extending parallel to the slot and over the entire length of the slot, said connecting wall including a weakened zone which extends along the entire length of said connecting wall and which is resiliently deformable and forms a pivot axis parallel to the slot for said pair of spaced walls whereby the walls are pivotable about the pivot axis extending parallel to the slot, the cavity formed by said pair of spaced walls being divided by said connecting wall into a lower pressure chamber conducting the flow medium to be expelled from the slot and an upper counter pressure chamber whereby the pressure of the flow medium disposed in the lower pressure chamber acts in the sense to open the slot and the pressure of the flow medium disposed in the upper counter pressure chamber acts in the sense to close the slot.

13. The slot nozzle according to claim 12, characterized in that in the upper counter pressure chamber a flexible tube for conducting the fluid is provided, the walls of said flexible tube being in contact with the counter pressure chamber walls and being resiliently deformable.

14. The slot nozzle according to claim 12 characterized in that said cavity is divided into two substantially equally sized pressure chambers by said connecting wall.

15. The slot nozzle according to claim 12 characterized in that said upper counter pressure chamber is larger than the lower pressure chamber, and further comprising a fluid supply conduit in communication with said lower pressure chamber, and a bypass conduit in communication between said counter pressure chamber and said supply pressure chamber.

16. The slot nozzle according to claim 15, characterized in that an adjustable pressure relief valve is disposed in the bypass conduit.

17. The slot nozzle according to claim 12, characterized in that the upper counter pressure chamber has associated therewith an adjusting means for setting the minimum slot width.

* * * * *